US007490568B2

(12) United States Patent
Matsuda et al.

(10) Patent No.: US 7,490,568 B2
(45) Date of Patent: Feb. 17, 2009

(54) BEARDED NEEDLE

(75) Inventors: Toshihiko Matsuda, Nagano (JP); Mutsumi Sekiguchi, Nagano (JP)

(73) Assignee: Organ Needle Co., Ltd., Ueda-shi, Nagano-ken (JP)

( * ) Notice: Subject to any disclaimer, the term of this patent is extended or adjusted under 35 U.S.C. 154(b) by 0 days.

(21) Appl. No.: 11/833,814

(22) Filed: Aug. 3, 2007

(65) Prior Publication Data

US 2008/0035039 A1 Feb. 14, 2008

(30) Foreign Application Priority Data

Aug. 10, 2006 (JP) ..... 2006-217856

(51) Int. Cl.
*D05B 85/04* (2006.01)
*D04B 35/02* (2006.01)

(52) U.S. Cl. ..... 112/222; 66/116

(58) Field of Classification Search ..... 112/116, 112/222, 224; 223/102; 66/116, 117, 118, 66/119

See application file for complete search history.

(56) References Cited

U.S. PATENT DOCUMENTS

| | | | | |
|---|---|---|---|---|
| 1,303,327 | A * | 5/1919 | Jensen | 66/118 |
| 2,635,444 | A * | 4/1953 | Carlson | 66/118 |
| 4,790,254 | A | 12/1988 | Vornholt | |
| 5,771,173 | A | 6/1998 | Tsonis et al. | |
| 6,973,807 | B2 * | 12/2005 | Bruske et al. | 66/116 |

FOREIGN PATENT DOCUMENTS

| | | |
|---|---|---|
| GB | 23159 | 11/1913 |
| JP | 63-162290 | 7/1988 |

* cited by examiner

*Primary Examiner*—Ismael Izaguirre

(57) ABSTRACT

A bearded needle comprises a needle shank whose tip is shaped into a thin shank portion by tapering down the thickness of the needle shank. The thin shank portion has a conical projection portion at the extremity thereof. The conical projection portion has a hooking tip portion to form a hooking portion at the tip of the needle shank. The hooking portion has a substantially U-shaped bottom portion that hooks and holds a thread, and includes sloping surfaces each inclining toward an outer edge of the hooking tip portion. The sloping surfaces each extend from the bottom portion over both the conical projection portion and the hooking tip portion.

11 Claims, 6 Drawing Sheets

BEARDED NEEDLE

BACKGROUND OF THE INVENTION

1. Field of the Invention

The present invention relates generally to a bearded needle used mainly for Sagara embroidery (looped stitches), and more particularly, to a bearded needle that can attain uniform finishing with stable off-hooking of a thread in Sagara embroidery.

2. Description of the Related Art

As conventional bearded needles, there have been those for a book binding stitcher, a knitting machine, etc. FIGS. 3A and 3B illustrate a bearded needle for a book binding stitcher that has the following configuration. A needle body 1 includes a conical tip 2 formed at a head portion thereof and a tonguelet 4 extending from the conical tip 2 and being bent in a U-shape at a narrow portion 3, wherein a needle eye 5 is formed between the needle body 1 and the tonguelet 4 to form a hooking portion to hook a thread. The width of the needle eye 5 is nearly the same as the width of a thread, but the width of the needle eye 5 is made slightly wider to ensure the smooth sliding of a thread. A thread hooked at the hooking portion is retained to form a U-shape loop, and the width of the U-shape loop can be made narrower by the provision of the narrow portion 3. While friction that is generated when a thread is pulled out is large and the thread could be cut in a case that the width of the U-shape loop is wide, the friction can be reduced by narrowing the width of the U-shape loop (see e.g., Japanese Patent Laid-Open Application No. 63-162290).

A conventional bearded needle used in Sagara embroidery is explained referring to FIGS. 4A to 4C. A bearded needle of this type has the following configuration. A needle body 6 includes a needle shank 6*a* and a hooking portion 7 formed at a tip portion thereof. The hooking portion 7 includes a narrow shank portion 6*b* formed at the distal end of the needle shank 6*a* and a conical projection portion 8 provided at a tip of the narrow shank portion 6*b*. The conical projection portion 8 has a hooking tip portion 9 that points backward to form a needle eye 6*c* where a thread is hooked. At the hooking tip portion 9, as illustrated in FIG. 4C, thread guiding grooves 6*d* where a thread S is hanged on are formed on the two sides of the hooking portion 7. Reference character 6*b*' denotes the side of the narrow shank portion 6*b*, and reference character 9' denotes the side of the hooking tip portion 9. In order to prevent the hooking tip portion 9 of the bearded needle 6 from trapping by hooking a base cloth when the bearded needle 6 is drawn from the base cloth, the width D from the outer end of the needle shank 6*a* to the end, on the side of the needle eye 6*c*, of the hooking tip portion 9 needs to be formed wide enough. There are problems that in the case that the width D is narrow, while it is allowed to form the width of the needle eye 6*c* wide, the hooking tip portion 9 may hook the base cloth and hence roughening of the base cloth may be caused, and that in the case that the width D is wide, the needle eye 6*c* and the thread guiding grooves 6*d* become narrow accordingly, and hence off-hooking of a thread becomes instable.

In Sagara embroidery (looped stitches), there are chain stitch and loop stitch. As illustrated in a step sequence (1) to (10) in FIG. 6, the chain stitch has planar stitches formed by loops connected like a chain. In step (1), a thread S is hooked by the hooking portion 7 of the bearded needle 6 and drawn out from a base cloth C, and the bearded needle 6 is elevated to a top dead center. In steps from (2) to (5), after stopping the rotation of a looper T, the bearded needle 6 is lowered to pierce through the base cloth C, and is inserted into a needle insertion hole Ta of the looper T while the looper T is being rotated clockwise, and the thread S is off-hooked from the hooking portion 7 during the lowering process, and the bearded needle 6 is further lowered. In steps from (6) to (10), the thread S is wound around the bearded needle 6 by the clockwise rotation of the looper T, then the thread S is hooked by the hooking portion 7 of the bearded needle 6 by elevating the bearded needle 6, a new loop P is formed by further elevating the bearded needle 6 inside a previously formed loop P to the top dead center, and the thread S hooked by the bearded needle 6 goes through the previously formed loop P by rotating the looper T counterclockwise to an initial position and moving the base cloth C in the direction indicated by an arrow Y, thereby forming the new loop, resulting in chained loops being formed by repeating the same steps.

Loop stitch, which forms steric stitches (towel face stitches) by forming separate standing-up loops one by one, is explained in a step sequence from (1) to (10) in FIG. 7. Step (1) shows a state that a bearded needle 6 has reached a top dead center, a loop P has been formed on a base cloth C, and the base cloth C has been moved. In steps from (2) to (5), the bearded needle 6 is lowered from the top dead center to pierce through the base cloth and to be inserted into a needle insertion hole Ta of the looper T that is stopped, and a thread S is wound around the needle shank of the bearded needle 6 by the clockwise rotation of the looper T during lowering of the bearded needle 6. As illustrated in steps (6) to (10), the thread S is hooked by a hooking portion 7 by elevating the bearded needle 6 during rotating of the looper T clockwise, and a new loop P is formed on the base cloth C by elevating the bearded needle 6 to the top dead center to pierce through the base cloth C. In this step, rotation of the looper T is stopped, and the looper T is then rotated counterclockwise to an initial position, and the loop $P_1$ is off-hooked from the hooking portion 7 by moving the base cloth C in the direction Y indicated by an arrow, resulting in loop stitches being formed by repeating the same steps.

In loop stitch, as is obvious from FIG. 7, if a thread is not off-hooked from a hooking portion of a bearded needle at a constant timing, irregularity in the size and standing angle of loops is caused, and hence clear embroidery patterns cannot be attained. Therefore, in order to realize clearly finished embroideries, off-hooking of the thread from the hooking portion of the bearded needle needs to be done regularly at a constant timing. The off-hooking of a thread from the hooking portion is done, as illustrated in FIG. 5A, at a step where a bearded needle 6 is being lowered after the bearded needle 6 has once reached a top dead center after a thread S is drawn out by a hooking portion 7. As illustrated in FIG. 5B, however, in the conventional art, the tension of the thread S could loosen when the bearded needle 6 is slightly lowered from the top dead center, and thereby the tip portion of the bearded needle 6 could be inserted and pierced between the twists (parts of the thread Sa, Sb) of the stranded thread S. Especially, in loop stitch with a narrow stitching interval, the possibility of the thread S being trapped by the tip portion of the bearded needle 6 is high, and if such a trapping occurs, and the thread is not broken, a poor-finished embroidery in which the stitches of chain stitch are formed on a base cloth is provided.

SUMMARY OF THE INVENTION

The present invention has been made in consideration of the above problems. Accordingly, it is an object of the present invention to provide a bearded needle that is able to stably off-hook a thread, and thus is able to attain embroideries with good finishing without irregularity.

In order to achieve the above object, according to the present invention there is provided a bearded needle. The bearded needle comprises: a needle shank including a thin shank portion at a tip thereof which is formed to taper by gradually reducing the thickness of the needle shank; a conical projection portion provided at an extremity of the thin shank portion; and a hooking tip portion provided on the conical projection portion to form a hooking portion at a distal end of the needle shank, the hooking portion having a substantially U-shaped bottom portion that hooks and holds a thread, wherein the hooking portion includes sloping surfaces on both sides thereof, the sloping surfaces each inclining toward an outer edge of the hooking tip portion and each extending from the bottom portion over both the conical projection portion and the hooking tip portion.

In a preferred embodiment of the present invention, each of the sloping surfaces inclines in a direction toward the most distal end of the hooking tip portion.

In a preferred embodiment of the present invention, each of the sloping surfaces is a plain or curved surface.

The configuration of the bearded needle according to the present invention offers such an advantage that when a thread hooked at the hooking portion of the bearded needle is off-hooked, the thread slides on the sloping surfaces being drawn to a position offset from the central axis of the needle toward the outer direction, and while the tip of the conical projection portion is lowered along the central axis of the needle, the thread is drawn out so as to avoid the position right beneath the tip of the conical projection portion, that is located on the extension line of the central axis of the needle, thereby the tip of the conical projection portion does not pierce into the thread when the bearded needle is lowered, and hence embroideries with good finishing without chains accidentally being formed by the trapping of a thread are attained. In addition, since a thread is off-hooked at a constant timing, there is an advantage that embroideries with good finishing with loops in a regular size and a constant standing angle are attained.

In the case of the sloping surfaces each inclining in the direction toward the most distal end of the hooking tip, such an advantage is offered that the off-hooking of a thread is done more constantly because the thread hooked by the hooking portion can smoothly move toward the outer direction of the hooking tip portion.

In the case of the sloping surfaces each being a plane or curved surface, such an advantage is offered that the trapping of a thread by the tip of the bearded needle when the bearded needle is being lowered is avoided because the thread hooked by a hooking portion slides on the sloping surfaces toward the outer edge of the hooking tip portion and is drawn out while being offset from the central axis of the needle.

DESCRIPTION OF THE PREFERRED EMBODIMENTS

Figure 1A:
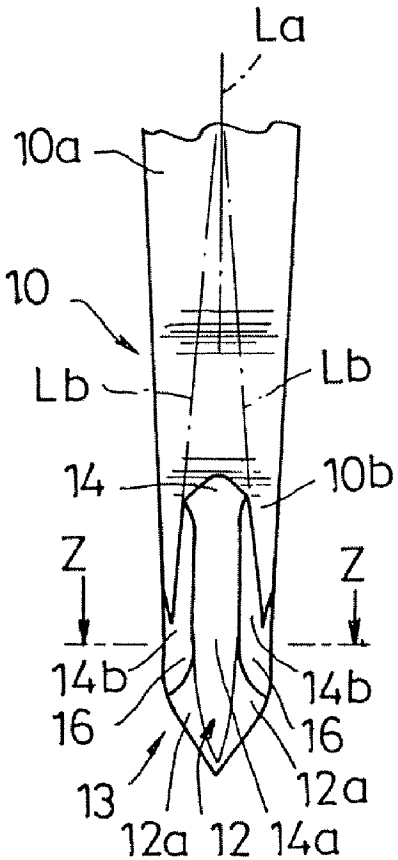
FIGS. 1A and 1B are an elevation view to illustrate a bearded needle in accordance with an embodiment of the present invention and a side view thereof, respectively.
Figure 1B:
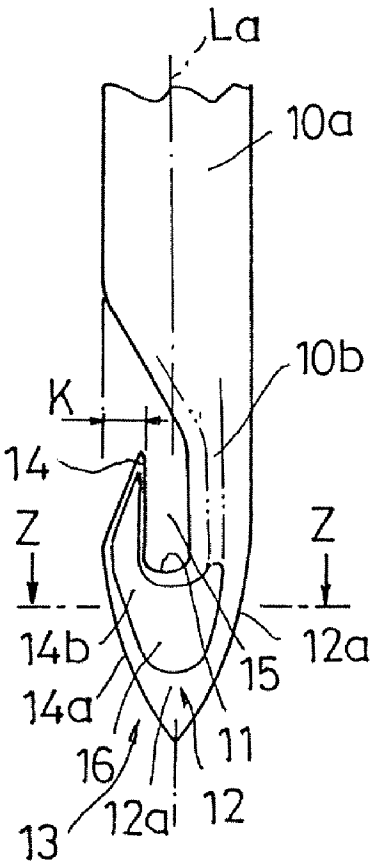
Figure 1C:
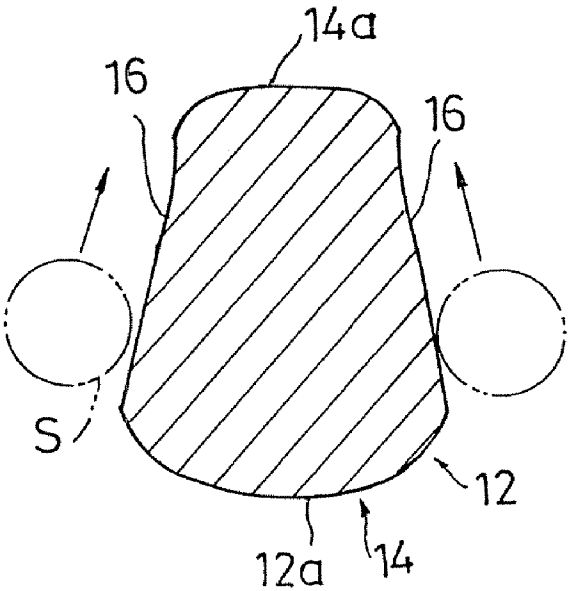
FIG. 1C is an enlarged cross-sectional taken on a plane of lines Z-Z of FIGS. 1A and 1B.
Figure 2A:
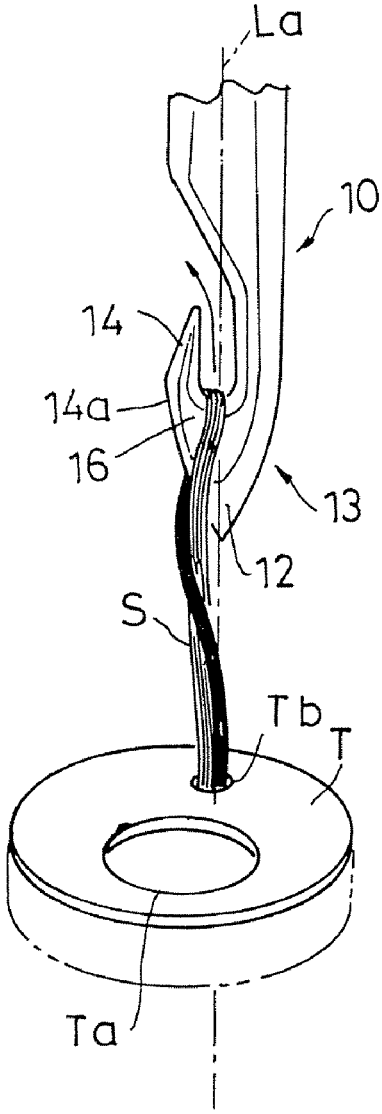
FIGS. 2A and 2B illustrate a state when the bearded needle of this embodiment has drawn out a thread and a state when the bearded needle of this embodiment is slightly lowered, respectively.
Figure 2B:
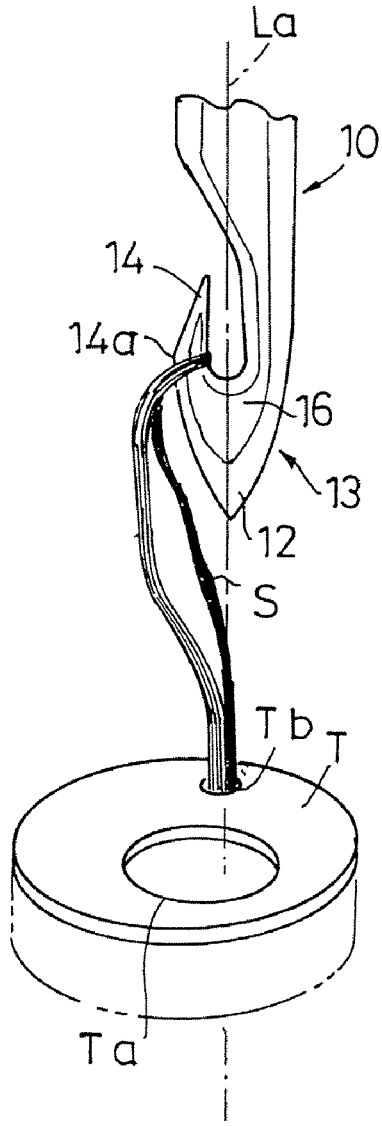
Figure 3A:
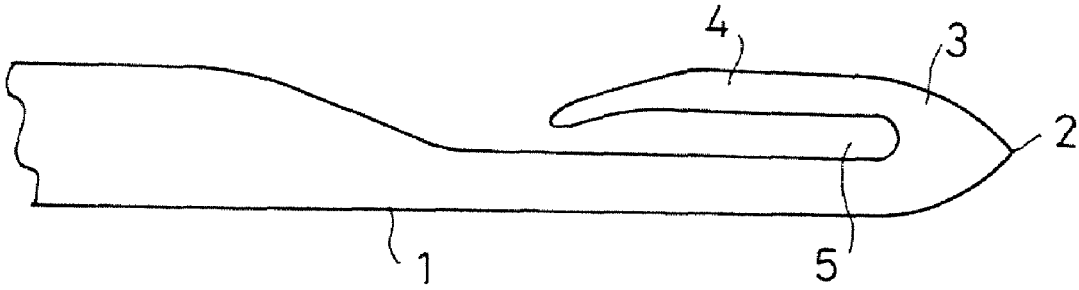
FIG. 3A PRIOR ART
FIGS. 3A and 3B are a side view of a conventional bearded needle and a front view thereof, respectively.
Figure 3B:
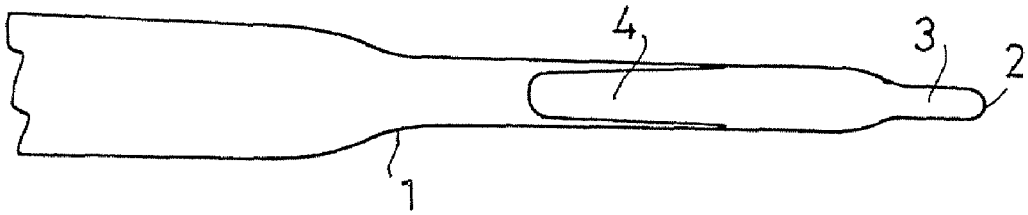
FIG. 3B PRIOR ART

An embodiment of a bearded needle according to the present invention will now be described in detail with reference to the accompanying drawings. FIGS. 1A to 1C depict an embodiment of the bearded needle according to the present invention. FIGS. 2A and 2B illustrate a state when the bearded needle has drawn out a thread and a state when the bearded needle is slightly lowered, respectively. While a conventional bearded needle has thread guiding grooves at a thread holding portion, the bearded needle in this embodiment is provided with sloping surfaces, instead of forming the thread guiding grooves, in the position corresponding to the thread holding portion to facilitate the movement of a thread, which embodiment is explained in detail below.

As illustrated in FIGS. 1A to 1C, the bearded needle of this embodiment has the following configuration. A bearded needle 10 of the illustrated embodiment includes a needle shank 10*a* and a hooking portion 13 disposed at a tip portion of the needle shank 10*a*. The tip of the needle shank 10*a* is formed into a thin shank portion 10*b* by tapering down the thickness of the needle shank 10*a*. The thin shank portion 10*b* is provided at an extremity thereof with a conical projection portion 12. The conical projection portion 12 is provided at a proximal side thereof with a beard or hooking tip portion 14 pointing back in a direction toward the thin shank portion 10*b* to form a needle eye 15, and thereby the hooking portion 13 is formed at the tip of the needle shank 10*a* so as to hook a thread S at the needle eye 15 thereof. A bottom portion 11 of the hooking portion 13 to hold the thread S is formed into a substantial U-shape. At the thread holding portion of the hooking portion 13, instead of thread guiding grooves formed in a conventional bearded needle, as illustrated in FIG. 1C, a pair of sloping surfaces 16 inclining toward an outer edge 14*a* of the hooking tip portion 14 are each formed in an area extending from the bottom portion 11 over both the conical projection portion 12 and the hooking tip portion 14.

Each of the sloping surfaces 16 is a surface that inclines toward the outer edge 14*a* of the hooking tip portion 14 in an area extending from the vicinity of the bottom portion 11 to both the lateral surface 12*a* of the conical projection portion 12 and the lateral surface 14*b* of the hooking tip portion 14. The sloping surfaces 16 are formed on both sides of the conical projection portion 12 and the hooking tip portion 14. By forming the sloping surfaces 16 on both sides of the hooking portion 13, a thread hooked at the hooking portion 13 can be offset from a central axis La of the needle by its movement, as shown by arrows in FIG. 1C, toward the outer edge 14*a* of the hooking tip portion 14. The sloping surfaces 16 are formed to be symmetrical with respect to a plane including thereon the central axis La of the needle as shown in FIG. 1A. Each of the sloping surfaces 16 also inclines, as shown by auxiliary lines Lb in FIG. 1A, with respect to the plane of symmetry passing the central axis La of the needle toward the upper end of the needle shank 10*a*. Hence each of the sloping surfaces 16 is given an incline toward the distal end of the hooking tip portion 14, and thereby the thread S hooked at the hooking portion 13 can be offset further in the direction toward the outer edge 14*a* of the hooking tip portion 14. In other words, a thread is pulled out by the bearded needle 10 at a position apart from the central axis La of the needle.

In this embodiment, the off-hooking of a thread S hooked at the hooking portion 13 of the bearded needle 10 is executed in such a manner as illustrated in FIGS. 2A and 2B. More specifically, the thread S hooked at the hooking portion 13 of the bearded needle 10 is drawn out from a thread draw hole Tb in a looper T and the bearded needle 10 is elevated to the top dead center (FIG. 2A). Since thread guiding grooves are not formed at the hooking portion 13 of the bearded needle 10, when the bearded needle 10 is then lowered, the thread S is bent, as illustrated in FIG. 2B, to be offset to the side of the outer edge 14*a* of the hooking tip portion 14 by being slid along the sloping surfaces 16 of the hooking portion 13, and the thread S is positioned to be offset from the central axis La of the needle, whereby the tip of the conical projection portion 12 can be inserted into a needle insertion hole Ta of the looper T without piercing by the bearded needle 10 through the twists of the thread S when the bearded needle 10 is lowered. As the thread draw hole Tb is located eccentric to the center of the looper T, and hence the thread S is drawn by the hooking portion 13 out from the thread draw hole Tb at an angle so as to avoid the central axis La of the needle, the thread is not trapped when the bearded needle 10 is lowered, with the result that embroideries with good finishing can be attained.

In this embodiment, the sloping surfaces 16 are each formed to incline toward the outer edge 14*a* of the hooking tip portion 14, so that the position of a thread S can be offset toward the outer edge 14*a* of the hooking tip portion 14. Further, the sloping surfaces 16 are each formed to incline toward the most distal end of the hooking tip portion 14, so that the thread S can slide more smoothly in the direction of the outer edge 14*a* of the hooking tip portion 14 to be offset from the central axis La of the needle. The sloping surfaces may each be a plane or curved surface. Even in the case that each of the sloping surfaces 16 is a curved surface, a thread hooked at the hooking portion 13 can slide on the curved surface away from the central axis La of the needle, and since the thread is drawn out at a position offset from the central axis La of the bearded needle 10 when the bearded needle 10 is lowered, embroideries with good finishing without piercing by the bearded needle 10 through the twists of the thread S can be attained.

Figure 4A:
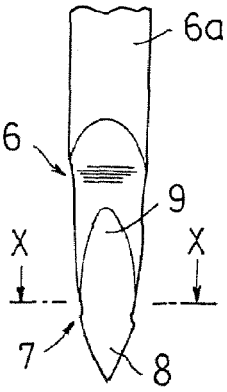
FIG. 4A PRIOR ART
FIGS. 4A and 4B are an elevation view of a conventional bearded needle and a side view thereof, respectively.
Figure 4B:
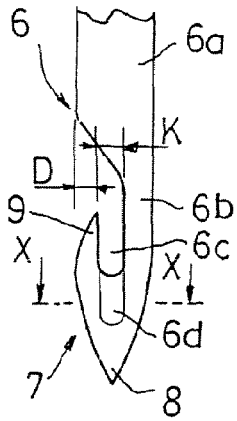
FIG. 4B PRIOR ART
Figure 4C:
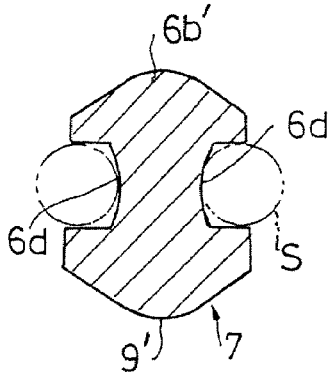
FIG. 4C PRIOR ART
FIG. 4C is an enlarged cross-sectional view taken on a plane of lines X-X of FIGS. 4A and 4B.
Figure 5A:
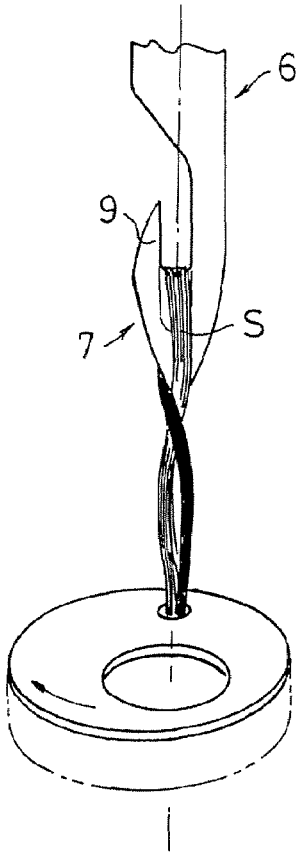
FIG. 5A PRIOR ART
FIG. 5A is a perspective view illustrating a state when a conventional bearded needle has drawn out a thread.
Figure 5B:
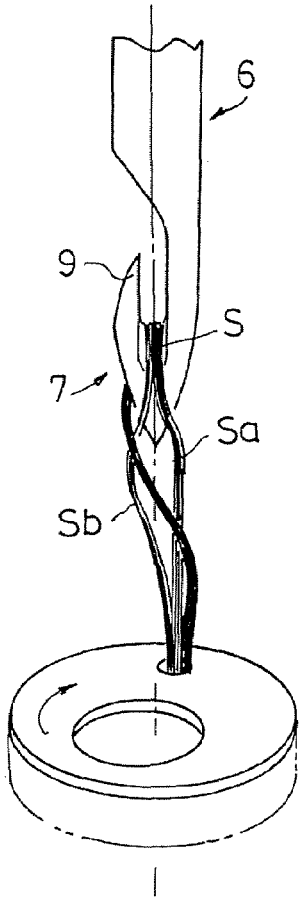
FIG. 5B PRIOR ART
FIG. 5B is a perspective view illustrating a trapping of a thread when the bearded needle is slightly lowered.
Figure 6:
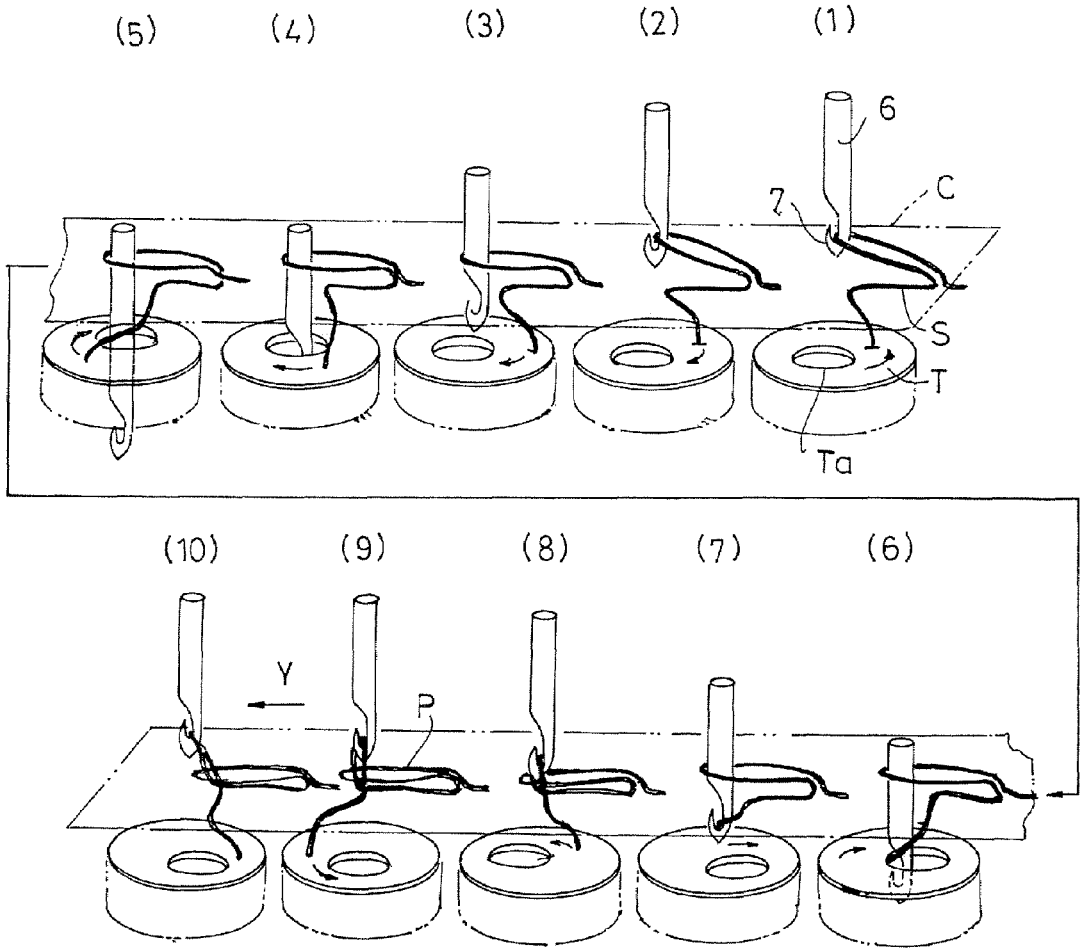
FIG. 6 illustrates a step sequence of chain stitch.
Figure 7:
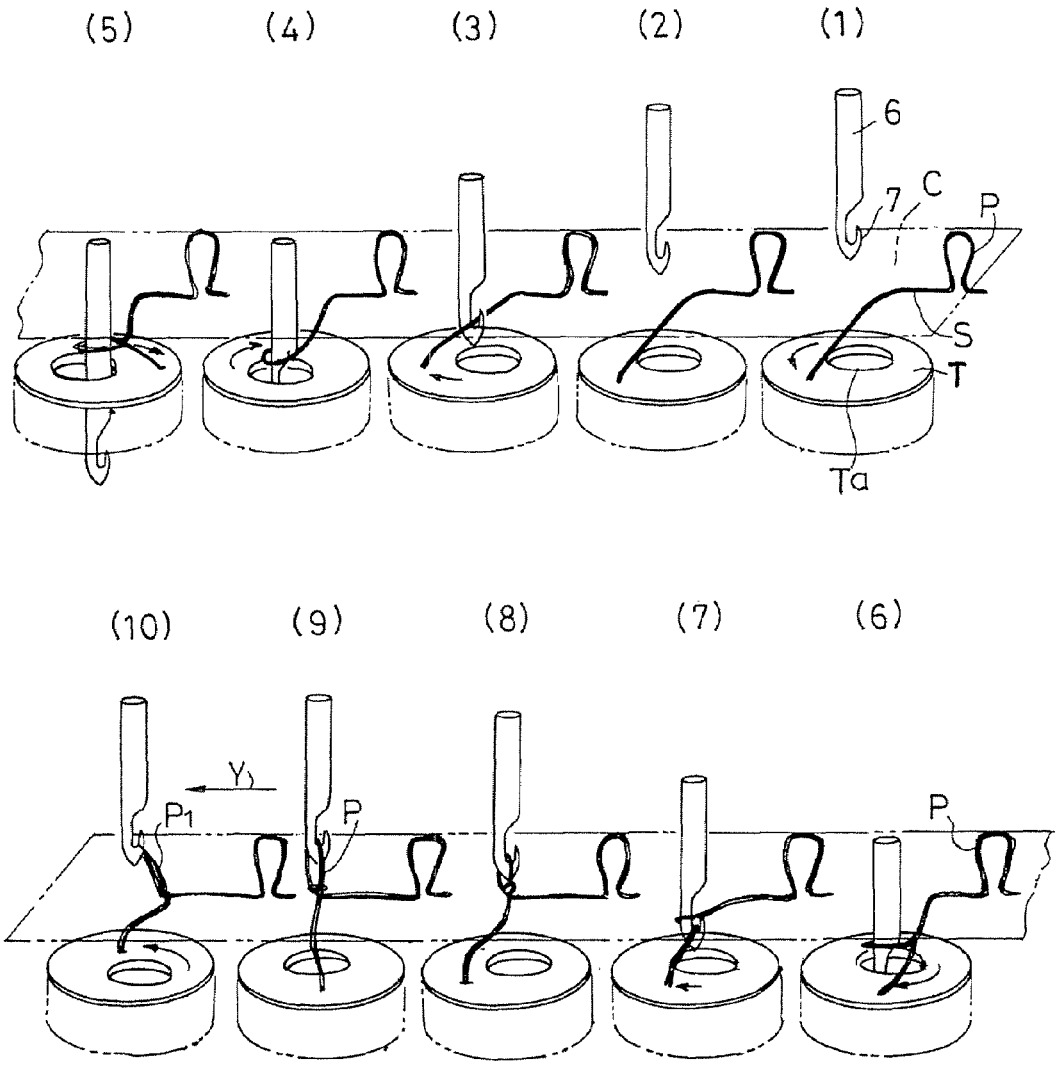
FIG. 7 illustrates a step sequence of loop stitch.

In addition, in this embodiment, the bearded needle 10 is designed to reduce the trapping of a base cloth by the tip of the hooking tip portion 14 when the bearded needle 10 is drawn out from the base cloth by making the lateral width of the tip of the hooking tip portion 14 of the bearded needle viewed from the front side thereof wider than that in the conventional bearded needle illustrated in FIGS. 4A to 4C. In other words, while in the conventional bearded needle, off-hooking of a thread is made difficult if the lateral width of the outer edge of a hooking tip portion is widened when a stitching interval is narrow; in this embodiment, thread guiding grooves are not formed unlike in the conventional bearded needle, and the hooking portion is formed in such a manner that the lateral width of the hooking tip portion is narrower at the outer edge thereof than on the side of the central axis of the needle and the hooking portion has the sloping surfaces that have a relatively large inclination angle, and thereby a thread hooked at the thread holding portion can smoothly move slide on the sloping surfaces toward the outer edge of the hooking tip portion and since a standing thread loop is off-hooked from the hooking tip portion when the bearded needle is lowered, the width of the tip portion of the hooking tip portion on the side of the central axis of the needle can be made wider than that in the conventional needle, so that there is an advantage that off-hooking of the thread becomes stable, thus attaining embroideries with good finishing without trapping of the bearded needle by the base cloth.

In this embodiment, since thread guiding grooves are not formed at the thread holding portion of the bearded needle, flexibility in movement of a thread is high, and the bearded needle is designed so that a thread slides smoothly according to the incline angle of the sloping surfaces and stably stays in place. In addition, the incline angle of the sloping surfaces can be adjusted depending upon the pitch of embroidery stitch (seam), and it is also possible to attain stable off-hooking of a thread from the bearded needle by providing the sloping surfaces with an appropriate curvature. The incline angle of the sloping surface means an angle with respect to the central axis of the needle at which angle the sloping surface inclines toward the central axis of the needle and/or an angle with respect to a line that is orthogonal to the central axis of the needle and that extends in the direction of the outer edge of the hooking tip portion at which angle the sloping surface inclines toward the orthogonal line.

The present invention is applicable to a bearded needle suitable for Sagara embroidery.

What is claimed is:

1. A bearded needle comprising:

a needle shank having a central axis, La, including a thin shank portion at a tip thereof which is formed to taper by gradually reducing the thickness of the needle shank;

a conical projection portion provided at an extremity of the thin shank portion; and a hooking tip portion provided on the conical projection portion to form a hooking portion at a distal end of the needle shank, the hooking portion having a substantially U-shaped bottom portion that hooks and holds a thread, wherein the hooking tip portion includes sloping surfaces on both sides thereof, the respective sloping surfaces each incline toward each other and toward an outer edge of the hooking tip portion and each sloping surface extending from the bottom portion over both the conical projection portion and the hooking tip portion in a symmetrical relationship to a plane through the central axis.

2. The bearded needle of claim 1, wherein each of the sloping surfaces inclines in a direction toward the most distal end of the hooking tip portion.

3. The bearded needle of claim 1, wherein each of the sloping surfaces is a plane or curved surface.

4. The bearded needle of claim 2, wherein each of the sloping surfaces is a plane or curved surface.

5. A bearded needle comprising:

a needle shank including a reduced shank portion at a tip thereof which is formed to provide a conical projection at an extremity of the needle shank; and a hooking tip portion provided on a first side of the conical projection portion to form a hooking portion for a thread having a substantially U-shaped portion as viewed traverse to the first side to hook and hold the thread, the conical portion having slanted sloping surfaces on the hooking tip portion extending outward from adjacent the first side wherein each slanting sloping surface is closer to each other at the first side and extends in a cross section direction further away from each other as the respective slanting surface extends downward from the first side.

6. The bearded needle of claim 5 wherein the hooking tip portion has an upper surface that extends upward from an opening of the U-shaped portion and then downward to a point adjacent the extremity of the needle shank.

7. The bearded needle of claim 6 wherein a perimeter of the upper surface has an arrowhead configuration adjacent the opening of the U-shaped portion.

8. The bearded needle of claim 5 wherein the sloping surface comprises a majority of the viewed traverse side of the conical projection adjacent the U-shaped portion.

9. A bearded needle comprising:

a needle shank including a reduced shank portion at a tip thereof which is formed to provide a conical projection at an extremity of the needle shank; and a hooking tip portion provided on a first side of the conical projection portion to form a hooking portion for a thread having a substantially U-shaped portion recessed inward from an outer circumference of the shank portion as viewed traverse to the first side to hook and hold the thread, the conical portion having slanted sloping surfaces on the hooking tip portion extending outward from adjacent the first side wherein each slanting sloping surface is closer to each other at the first side and extends in a cross section direction further away from each other as the respective slanting surface extends downward from the first side wherein the sloping surfaces comprise a majority of the viewed traverse side of the conical projection adjacent the U- shaped portion.

10. The bearded needle of claim 9 wherein the hooking tip portion has an upper surface that extends upward from an opening of the U-shaped portion and then downward to a point adjacent the extremity of the needle shank.

11. The bearded needle of claim 10 wherein a perimeter of the upper surface has an arrowhead configuration adjacent the opening of the U-shaped portion.

* * * * *